US006287144B1

(12) United States Patent
Baffert

(10) Patent No.: US 6,287,144 B1
(45) Date of Patent: Sep. 11, 2001

(54) COAXIAL CONNECTOR ELEMENT COMPRISING A CONNECTION FOR LINKING THE CENTRAL CONDUCTOR OF A COAXIAL CABLE TO THE CONTACT OF THE CONNECTOR ELEMENT

(75) Inventor: Jean-Marc Baffert, Charavines (FR)

(73) Assignee: Radiall, Rosny-Sous-Bois (FR)

( * ) Notice: Subject to any disclaimer, the term of this patent is extended or adjusted under 35 U.S.C. 154(b) by 0 days.

(21) Appl. No.: 09/509,609

(22) PCT Filed: Jul. 30, 1999

(86) PCT No.: PCT/FR99/01897

§ 371 Date: Jun. 19, 2000

§ 102(e) Date: Jun. 19, 2000

(87) PCT Pub. No.: WO00/08723

PCT Pub. Date: Feb. 17, 2000

(30) Foreign Application Priority Data

Jul. 31, 1998 (FR) ..... 98 09863

(51) Int. Cl.[7] ..... H01R 9/05
(52) U.S. Cl. ..... 439/578; 439/582
(58) Field of Search ..... 439/582, 578, 439/581, 63, 394

(56) References Cited

U.S. PATENT DOCUMENTS 4,691,976 * 9/1987 Cowen ..... 439/582
5,597,323 * 1/1997 Resnick et al. ..... 439/582

FOREIGN PATENT DOCUMENTS

WO 09/31925 * 10/1996 (WO) .

* cited by examiner

*Primary Examiner*—Paula Bradley
*Assistant Examiner*—Felix D. Figueroa
(74) *Attorney, Agent, or Firm*—Schweitzer Cornman Gross & Bondell LLP

(57) ABSTRACT

A coaxial connector element including an outer contact connected to the outer conductor of a coaxial cable, a central contact having a longitudinal axis and circularly-symmetrical neck at a rear end, and a coupling mounted on the central conductor of the coaxial cable, the coupling provided with a resilient fork having two prongs defining a seat between them for snap-fastening the neck of the central contact. Each prong having a pointed end defined by two cylindrical recesses, whereby when the coupling initially contacts the neck of the central contact, the coupling is angularly offset from its normal snap-fastening position to a position in which the neck is securely engage by the fork.

6 Claims, 7 Drawing Sheets

8
12
17
18
19
20
21
22
23
24

COAXIAL CONNECTOR ELEMENT COMPRISING A CONNECTION FOR LINKING THE CENTRAL CONDUCTOR OF A COAXIAL CABLE TO THE CONTACT OF THE CONNECTOR ELEMENT

The present invention relates to a coaxial connector element including a coupling for connecting the central conductor of a coaxial cable to a central contact of the connector element.

BACKGROUND OF THE INVENTION

It is known that a coaxial connector element includes a central contact and an outer contact.

The central contact is designed to be connected to the central conductor of a coaxial cable, and the outer contact is designed to be connected to the outer conductor of the coaxial cable, which conductor is generally a grounding braid.

In most cases, the central contact is soldered via its rear end to the central conductor, while the outer contact, or the body of the connector element to which it is connected, is crimped to the braid.

Crimping the braid poses no particular problem, and is almost always satisfactory.

However, soldering the central conductor suffers from numerous drawbacks, among which mention can be made of the following:

- the difficulty of using the same quantity of solder from one connector element to another, which is essential to obtain impedance that is always identical;
- the need to isolate the solder from the inside wall of the body of the connector element, in order to prevent a residual thread of solder from creating a short-circuit between the central conductor and ground; and
- the need to access the rear of the connector element at the time of installing it on a coaxial cable, in order to perform the soldering operation, which requires the presence of an opening that opens onto the rear end of the central contact.

A solution aimed at solving those drawbacks has already been proposed for an L-shaped connector element. That solution consists in providing a fork made up of two resilient prongs at that end of the central contact which is opposite from its connection end, and in providing a coupling on the central conductor of the coaxial cable, which coupling is organized to snap-fasten between the two prongs of the fork of the central contact. That coupling avoids the necessity of performing soldering inside the connector element and guarantees that a predetermined impedance is obtained.

It is thus not necessary to provide an opening in the rear of the connector element because the coupling can be snap-fastened into the central contact via the radial access provided for feeding the cable into the connector element.

Unfortunately, since the rear end of the central contact is accessed radially only, the coupling can snap-fasten to the central contact only if said central contact is suitably angularly-positioned, i.e. if the gap between the two prongs of its fork face the radial opening.

It is thus necessary, in addition to the coupling, to provide keying shapes on the body of the connector element and on the central contact so as to prevent said central contact from rotating, which involves, in particular, specific machining operations which increase the cost of the connector element.

In addition, it is necessary to guide the coupling so as to feed it "blindly" to the fork and to cause it to penetrate accurately between the two prongs of said fork, which requires the additional presence of a guide piece in the body the connector element.

Therefore, although snap-fastening the central contact of the connector element to an intermediate coupling can avoid the drawbacks related to soldering the central contact of the cable, it suffers from numerous other drawbacks which make that solution unattractive.

SUMMARY OF THE INVENTION

An object of the present invention is to provide a novel solution to the problem of soldering the central conductor of the cable to the central contact of the connector element.

The present invention provides a coaxial connector element designed to be mounted on the end of a coaxial cable including a central conductor and an outer conductor, said connector element including:

- a central contact having a longitudinal axis and provided with a rear end connected to the central conductor of the coaxial cable and with a front end organized to connect the connector element to a complementary connector element; and
- an outer contact connected to the outer conductor of the coaxial cable;
- said coaxial connector element being characterized by the fact that it includes a coupling mounted on the central conductor of the coaxial cable, said coupling and the rear end of the central contact being shaped to snap-fasten together independently of the angular position of the central contact relative to its longitudinal axis.

It can be understood that the coupling of the invention offers the advantage, compared with the known coupling, that it is snap-fastened to the central contact of the connector element regardless of the angular position of the central contact, which is thus free to rotate about its own axis.

As a result, in the connector element of the invention, it is not necessary to provide keying means on the central contact.

In a preferred embodiment of the invention, the connector element is L-shaped. It then includes a body made up of a substantially-cylindrical connection portion in which the central contact and the outer contact are received, and of a cable coupling portion which is also substantially cylindrical, and which is provided with a radial sleeve for feeding in the cable.

In a preferred embodiment of an L-shaped coaxial connector element of the invention, the rear end of the central contact is provided with a circularly-symmetrical neck of the same axis as the longitudinal axis of the central contact, while the coupling is provided with a resilient fork having two prongs defining a seat between them for receiving the neck, the neck being snap-fastened in the seat in the fork by engaging the neck into the fork in a direction that is perpendicular to the longitudinal axis of the contact, the two prongs of the fork moving apart and resiliently moving back again once the neck has reached the seat.

In a preferred variant of this embodiment, the seat is defined by two cylindrical recesses facing each other, having their axes parallel to the separation plane of the two prongs, and each being formed in an inner face of respective one of the prongs of the fork.

Preferably, the diameter of the cylindrical recesses is smaller than the diameter of the neck of the central contact, which makes it possible to concentrate the contact pressures between the resilient prongs of the fork and the neck onto the angular edges of the recesses, so as to prevent oxides from forming on the contact surfaces, by limiting the quantity of oxidizing gases that can penetrate between said contact surfaces.

In a preferred embodiment of the invention, the free end of each prong of the fork is shaped into a point so as to impart a rotation torque to the coupling, and thereby to the central conductor of the cable, if the coupling enters into contact with the neck of the central contact while it is angularly offset relative to its normal snap-fastening position.

For example, the pointed end of each prong of the fork may be defined by two cylindrical recesses of axes perpendicular to the separation plane of the two prongs, and situated on either side of a midplane of the coupling that is perpendicular to the separation plane of the two prongs of the fork.

The pointed shape of the prongs of the fork is particularly useful because the coupling mounted on the end of the coaxial cable is inserted into the cable coupling portion blindly, i.e. without any possibility of visually inspecting that the coupling is angularly positioned properly relative to the neck of the central contact.

By means of the pointed shapes, and in particular the pointed shapes having concave rounded portions on either side of the point, on the prongs, if the coupling is presented in any inappropriate angular position but with the longitudinal axes of the coupling and of the contact being in the same plane, the ends of the prongs bear against the neck via their rounded edges that are diametrically opposite about the longitudinal axis of the coupling, thereby generating rotation torque tending to cause the coupling to rotate towards its snap-fastening angular position.

In other words, the edges of the points serve as angular guide cams for angularly guiding the coupling onto the neck.

The rotation torque generated in this way can either be sufficient to drive the coupling into the correct angular position automatically, in the event of a very small angular offset, the central conductor of the cable then absorbing the offset by twisting slightly in the coaxial cable, or else it can urge the operator who is putting the coupling in place in the connector element to rotate the cable so as to bring the coupling into its proper angular position.

In a particular embodiment, the coupling is obtained by cutting and rolling.

In another embodiment, the coupling is obtained by machining.

In another particular embodiment, the coupling is crimped onto the central conductor of the coaxial cable.

It can be understood that, by means of the invention, it is no longer necessary to provide an access opposite from the connection face of the connector element. Thus, the connector element of the invention may include an L-shaped body having no opening in its face opposite from its connection face.

DESCRIPTION OF THE DRAWINGS

To make the invention better understood, embodiments given by way of non-limiting example are described below with reference to the accompanying drawings, in which.

DETAILED DESCRIPTION OF THE INVENTION

Figure 1:
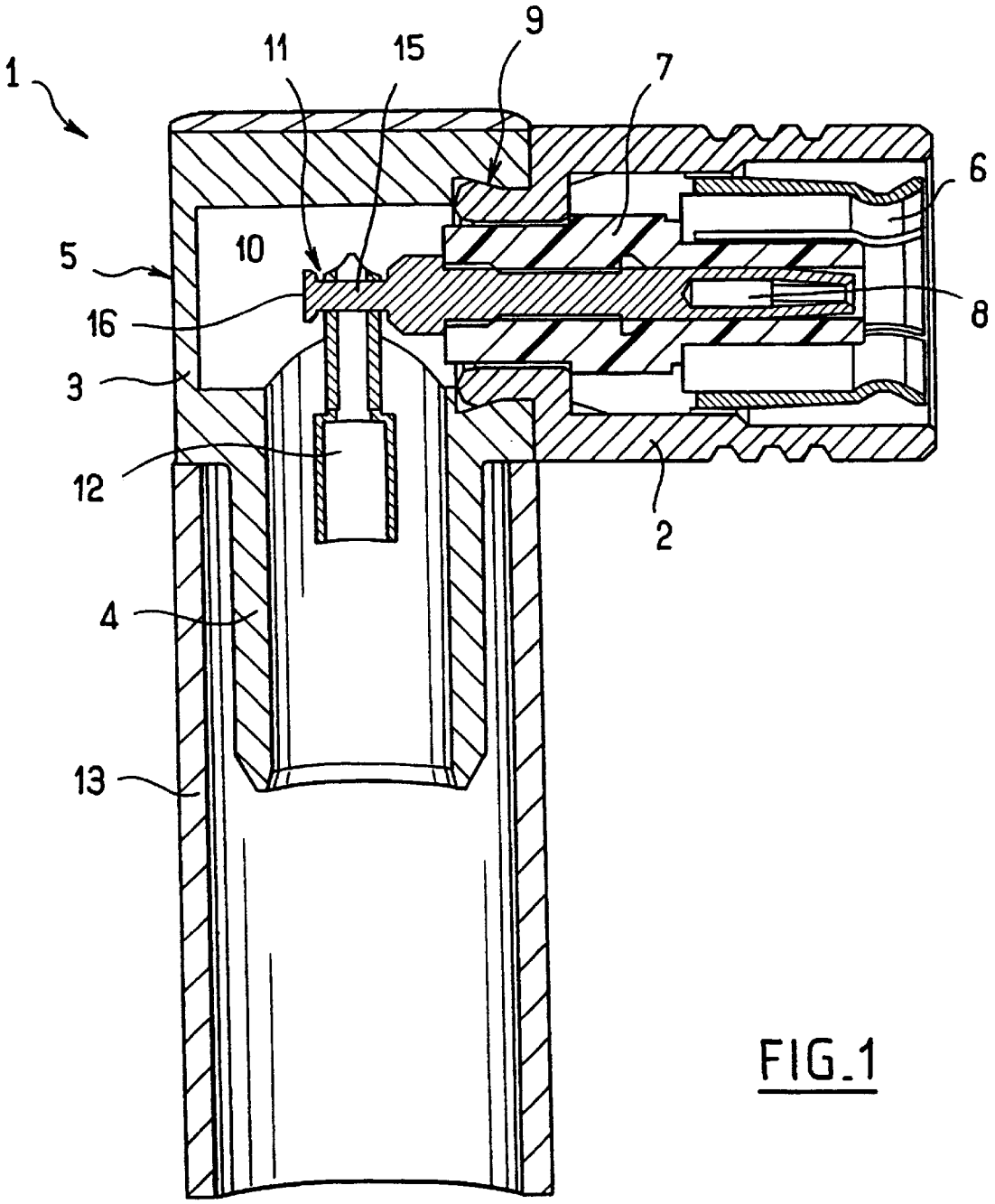
FIG. 1 is an axial section view of a coaxial connector element of the invention.

The connector element 1 shown in the drawings comprises a body in two portions, namely a cylindrical connection portion 2 and a cable-coupling portion 3 which extends the rear portion of the connection portion and is provided with an anvil-sleeve projecting radially in the vicinity of the rear face 5 of the connector element.

Going inwards from the outside, the inside of the connection portion of the body contains a resilient ground contact 6 which is force-fitted into the connection portion 2, a tubular insulator 7, and a central contact 8.

The details of the connection portion of the connector element are not explained herein because the invention is applicable to all sorts of connection interfaces and is not therefore limited to the interface shown in the drawings.

The cable coupling portion 3 of the body is crimped at 9 onto the connection portion and, behind the connection portion 2, it defines a pocket 10 for receiving the rear end 11 of the central contact 8 and for receiving a coupling 12 designed to be fastened to the end of the central conductor (not shown) of a coaxial cable (not shown).

The coupling 12 extends radially relative to the connection portion 2 and coaxially with the anvil-sleeve 4 of the coupling portion.

The coaxial cable (not shown) penetrates in known manner into the body of the connector element as follows. The braid of the cable, which braid constitutes its outer ground conductor, is engaged against the outside wall of the anvil-sleeve 4 and is crushed thereon by a crimping sleeve 13 which surrounds the anvil-sleeve 4.

The central conductor and its covering penetrate into the anvil-sleeve 4 and the coupling 12 is crimped onto the central conductor.

As in known coaxial connector elements, firstly the central conductor of the cable is connected electrically to the rear end of the central contact, and then the braid of the cable is crimped.

Figure 2:
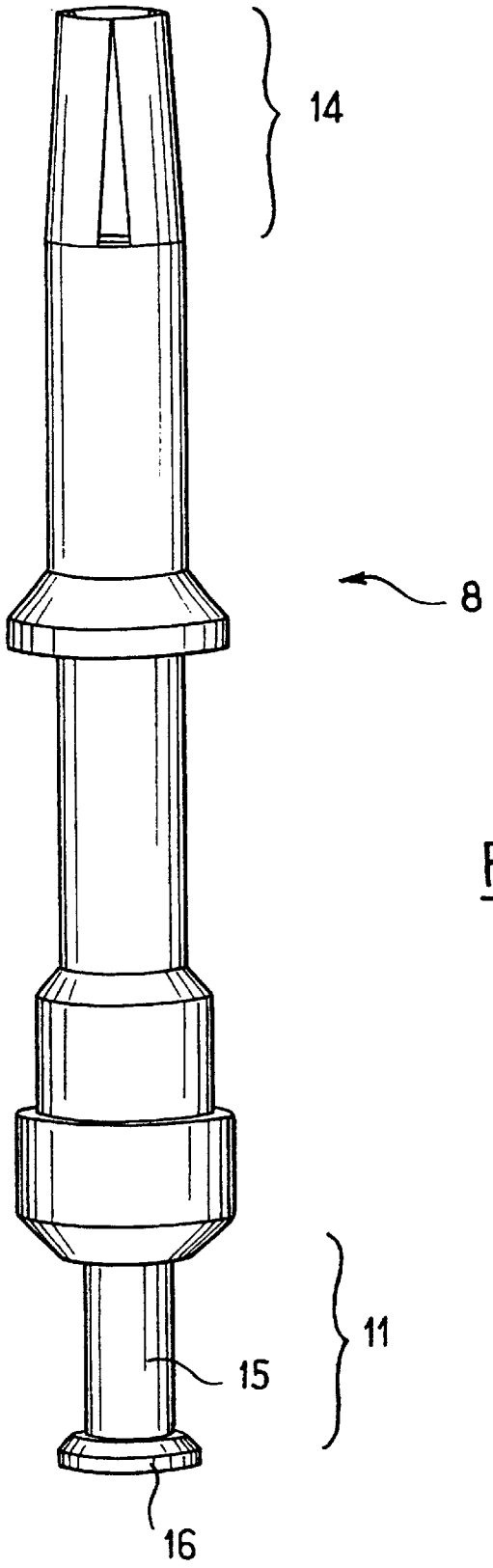
FIG. 2 is an elevation view of the central contact of the connector element of FIG. 1.

FIG. 2 shows that, at its front end 14, the central contact 8 is provided with a resilient zone which is capable of opening up to be force fitted or snap-fastened, depending on the type of interface in question, to the central contact of a complementary connector element.

The central contact 8 is provided with various shoulders and collars in its middle region, serving to retain it inside the insulating tube 7.

At its rear end 11, the central contact is provided with a circularly-symmetrical neck 15 terminated by a flat head 16. The shape of this head enables the line to be impedance-matched.

Figures 3, 4, 5:
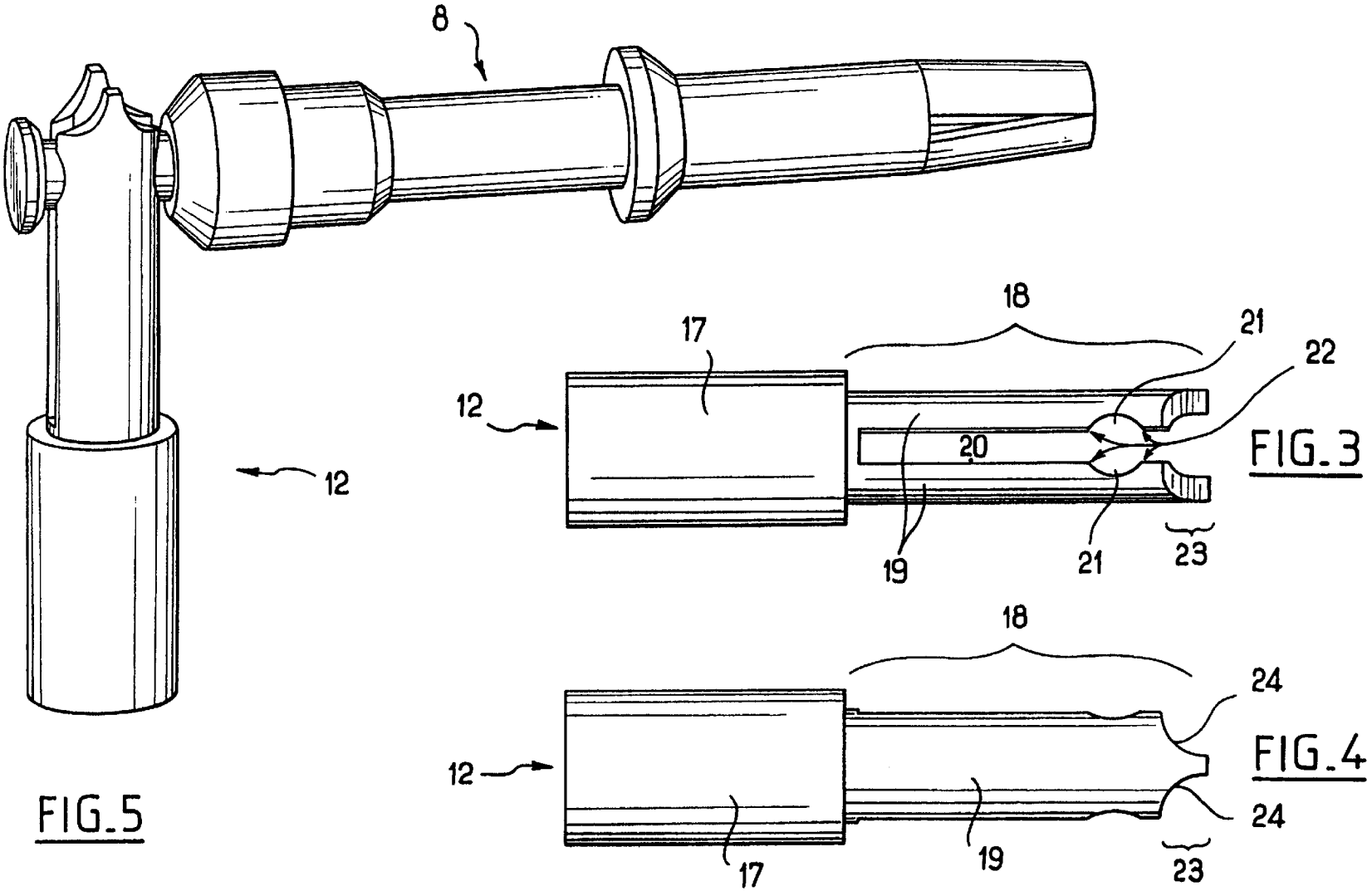
FIG. 3 is an elevation view of the coupling.
FIG. 4 is a plan view of FIG. 3.
FIG. 5 is a perspective view of the coupling as snap-fastened to the central contact.

The coupling 12, which is shown in elevation in FIGS. 3 and 4, comprises a crimping portion 17 at the rear, serving to be crushed onto the central conductor of the coaxial cable, and a resilient portion 18 at the front, made up of two prongs 19 cut out in a circular cylinder and separated by a gap 20 on a separation plane including the axis of the coupling.

The two prongs 19 as separated in this way are slightly resilient which enables them to move apart.

As can be seen more clearly in FIG. 3, the resilient prongs 19 of the coupling are provided with mutually-facing recesses 21. Each recess 21 has a cylindrical shape of axis parallel to the separation plane of the resilient prongs and perpendicular to the axis of the coupling.

The two facing cylindrical recesses 21 define a substantially cylindrical seat serving to receive the circularly-symmetrical neck 15 of the central contact 8.

The diameter of each recess 21 is less than the diameter of the neck 15, so that, once the snap-fastening has been performed, each of the recesses bears against the neck via its angular edges 22.

The purpose of such a configuration is to make the contact between the resilient prongs of the coupling and the neck as gastight as possible so that the oxidizing gases present in the ambient air do not oxidize the mutually-abutting surfaces of the coupling and of the contact.

The end 23 of each resilient prong of the coupling is shaped into a point so as to constitute ramps enabling the coupling to be released whenever it is angularly positioned wrongly facing the neck, as is explained below.

Each point of a resilient prong is defined by cylindrical concave shapes 24 of axis perpendicular to the axis of the seat provided between the resilient prongs.

Each concave shape 24 lies on a respective side of a midplane of the coupling.

Figure 6:
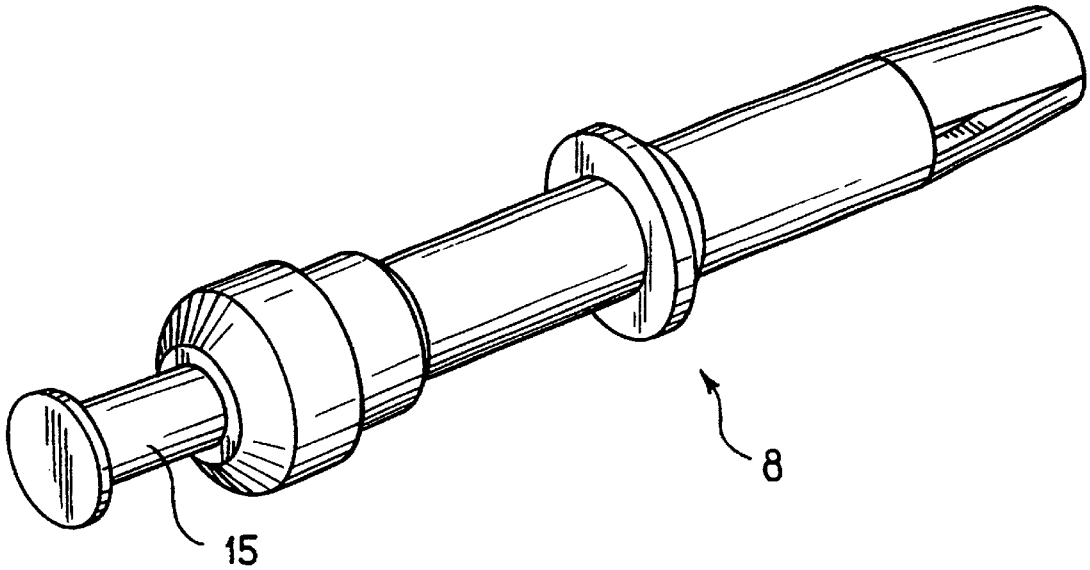
FIGS. 6 to 9 show the contact and the coupling during the snap-fastening operation.
Figure 6:
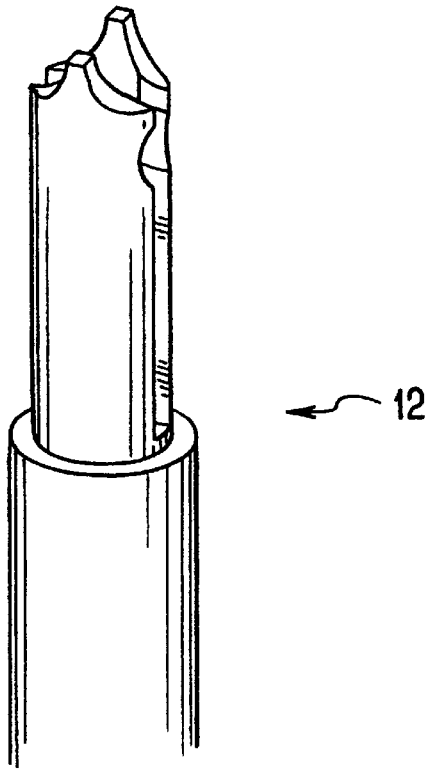

FIG. 6 shows the coupling 12 as it is approaching the neck 15 of the contact 8, and in an angular position that is unsuitable for snap-fastening it onto the neck.

Figure 7:
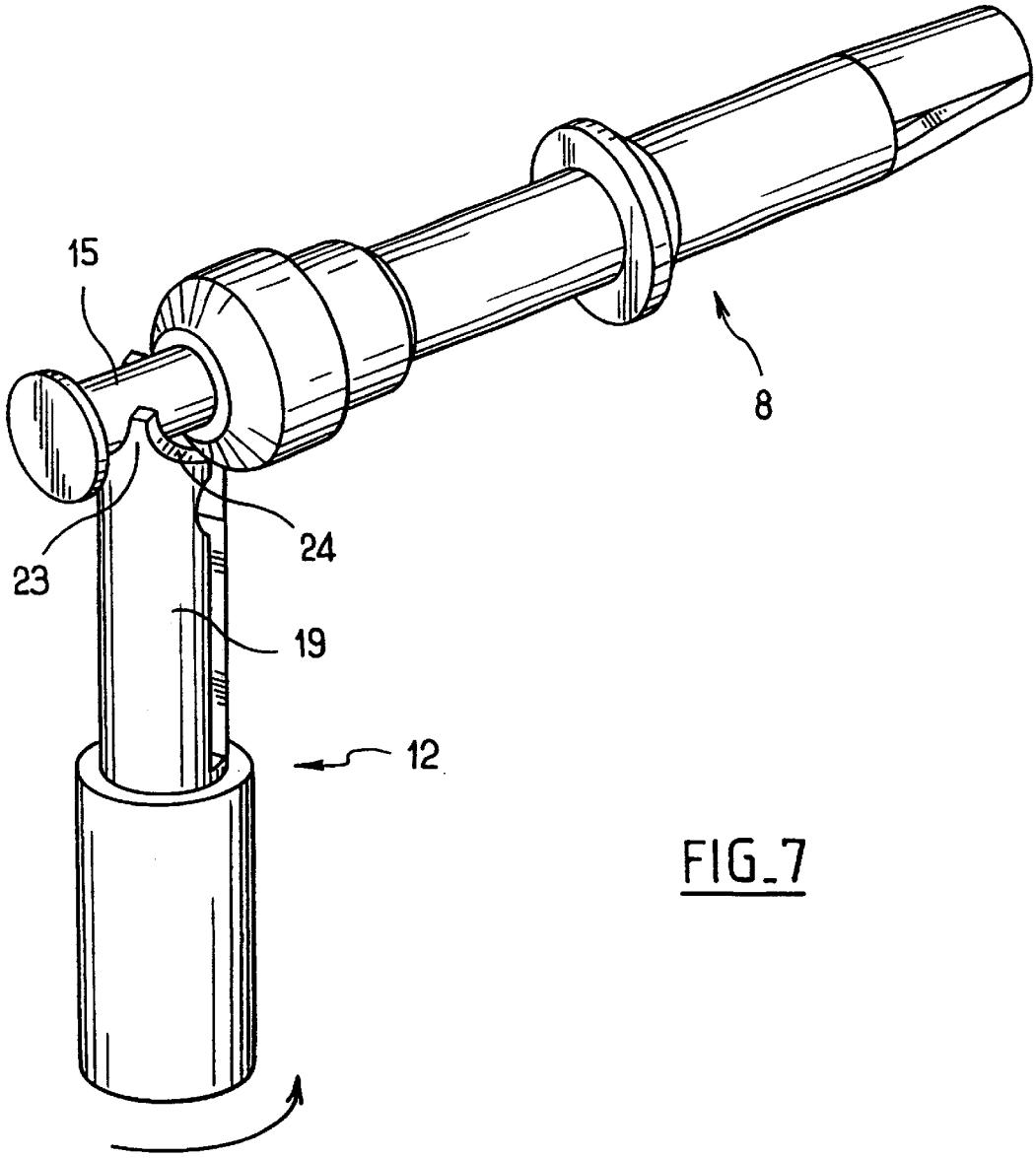

FIG. 7 shows the moment of contact between the ends of the resilient prongs 19 of the coupling and the neck 15, said neck bearing against the concave shapes 24 adjacent to the point of each prong.

Figure 8:
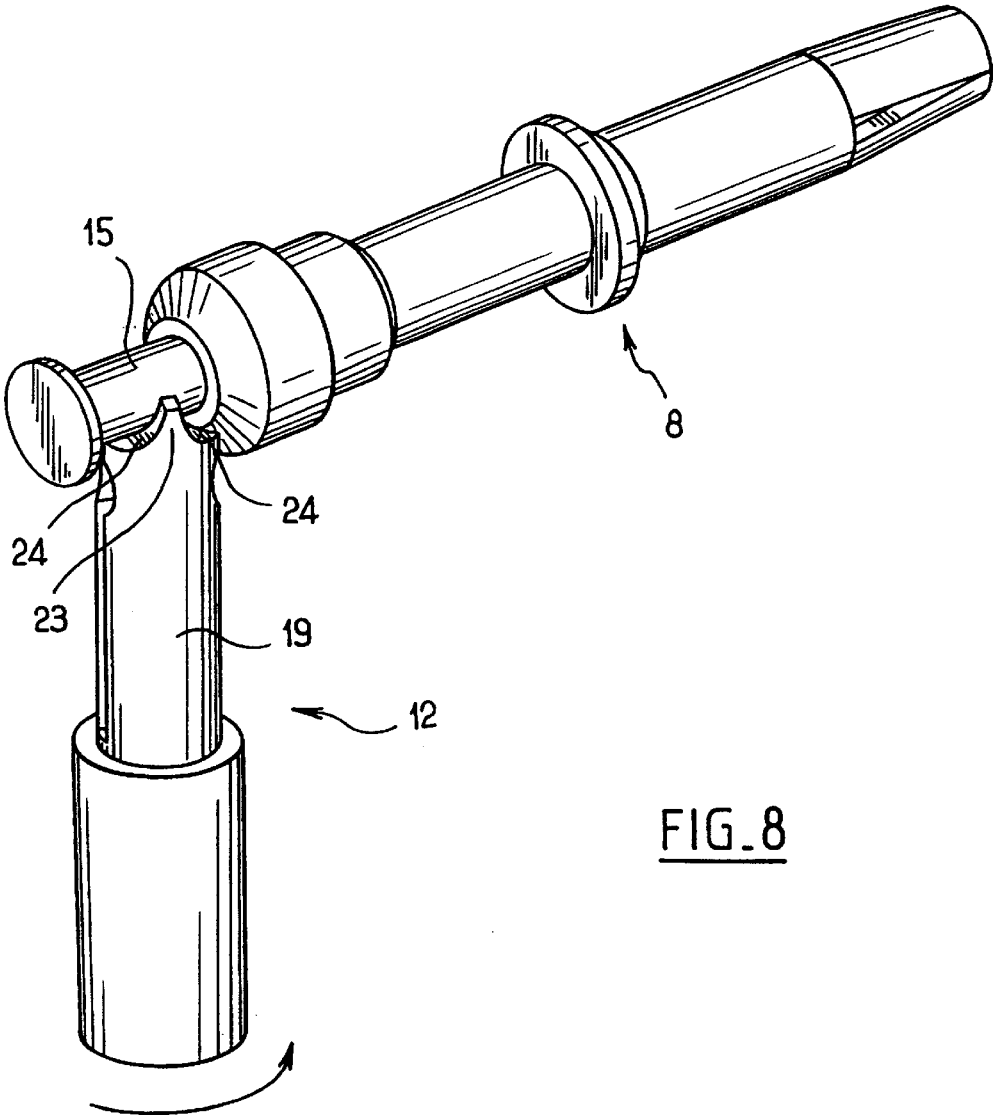
Figure 9:
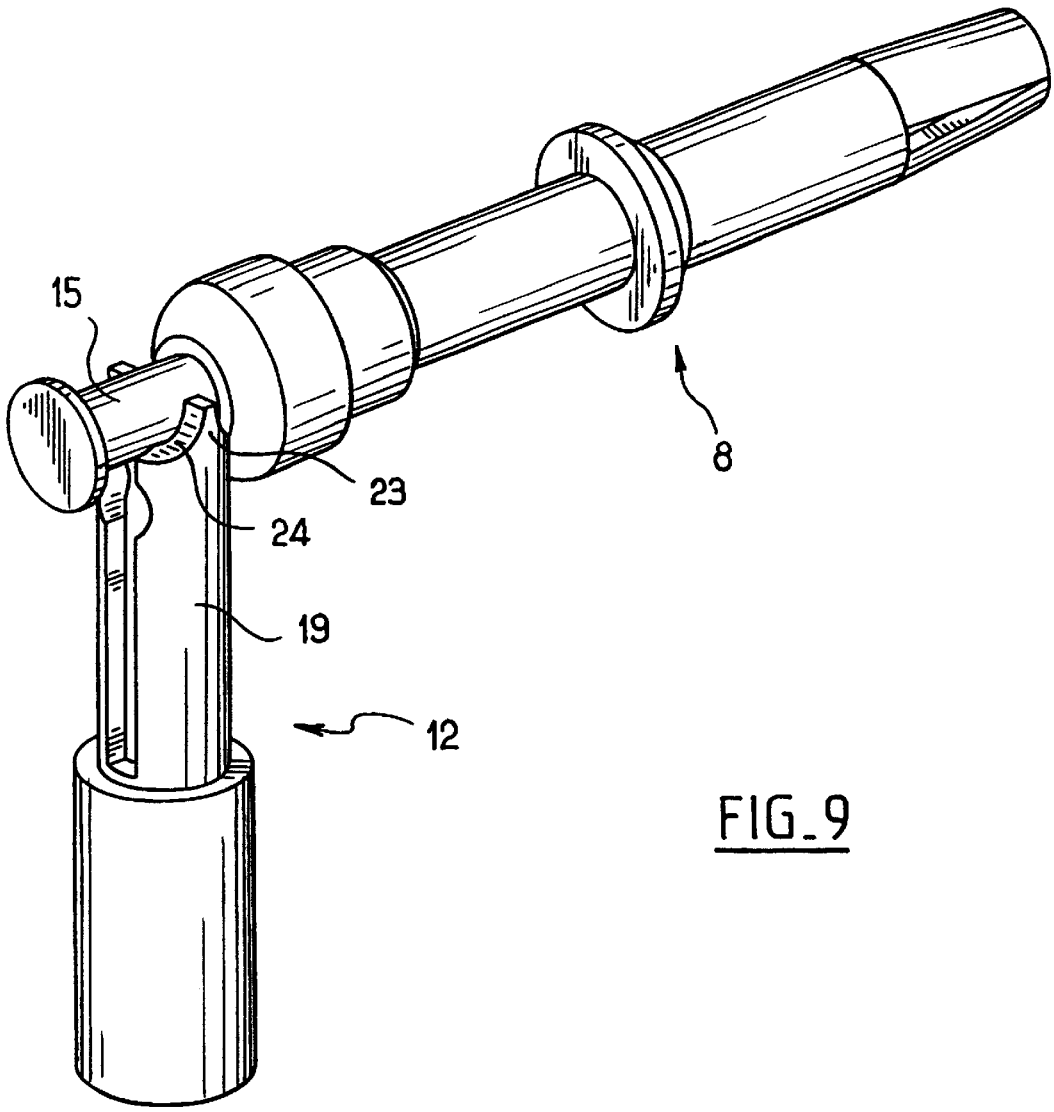

These concave shapes, which are cylindrical surfaces, act as cams which exert rotation torque on the coupling and tend to cause it to rotate in the direction indicated by the arrow in FIGS. 7 and 8 so as to place it in its snap-fastening position, as shown in FIG. 9.

Once the coupling is suitably angularly positioned, it is possible for it to continue to move forwards until the neck snap-fastens in the seat provided between the two resilient prongs, as shown in FIG. 5.

It should be noted that the rotation of the coupling as caused by it bearing via the concave edges of the two points, can take place under two circumstances.

The first circumstance is the circumstance under which the coupling has a small angular offset relative to its position in which it is snap-fastened onto the neck.

In which case, the torque exerted by the circular ramps of the points is sufficient to twist the central conductor of the cable, and the coupling comes into a suitable angular position without the operator having to modify the angular position of the cable.

The second circumstance is the circumstance under which the angular offset of the coupling is very large. In which case, the torque exerted by the guide ramps is transmitted, via the central conductor of the cable as twisted, to the fingers of the operator who then realizes that it is necessary to release their grip on the cable slightly, or even better, to turn the cable in the appropriate direction to enable the coupling to snap-fasten onto the neck.

Under both of the above-mentioned circumstances, the coupling is snap-fastened onto the neck blindly, i.e. without the operator visually inspecting the coupling.

Naturally, the above-described embodiment is in no way limiting, and it can receive any desirable modifications without going beyond the ambit of the invention.

What is claimed is:

1. A coaxial connector element adapted to be mounted on the end of a coaxial cable having a central conductor and an outer conductor, said coaxial connector element including:

(a) a central contact having a longitudinal axis and being provided with a rear end connected to the central conductor of the coaxial cable and being provided with a front end adapted to connect the connector element to a complementary connector element, (b) an outer contact connected to the outer conductor of the coaxial cable, and (c) a coupling mounted on the central conductor of the coaxial cable, wherein the rear end of the central contact is provided with a circularly-symmetrical neck having a longitudinal axis coincident with the longitudinal axis of the central contact; the coupling being provided with a resilient fork having two prongs defining a seat between them for receiving the neck, the neck being snap-fastened in the seat in the fork by engagement of the neck into the fork in a direction perpendicular to the longitudinal axis of the contact, (d) wherein each prong of the fork comprises a pointed end defined by two cylindrical recesses situated on either side of a midplane of the coupling, whereby when the coupling initially contacts the neck of the central contact while the coupling is angularly offset relative to a normal snap-fastening position, a rotation torque is imparted to the coupling to rotate it into a position in which said neck securely engages the fork.

2. A connector element according to claim 1, characterized by the fact that the connector element is L-shaped.

3. A connector element according to claim 2, in which the two cylindrical recesses have axes parallel to a separation plane of the two prongs, each recess being formed in an inner face of a respective one of the prongs of the fork.

4. A connector element according to claim 3, characterized by the fact that a diameter of the cylindrical recesses is smaller than the diameter of the neck of the central contact.

5. A connector element according to claim 1, characterized by the fact that the coupling is crimped onto the central conductor of the coaxial cable.

6. A connector element according to claim 1, characterized by the fact that the connector element includes an L-shaped body having no opening in a face opposite from a connection face.

* * * * *